US011565372B2

(12) United States Patent
Fenley, Jr.

(10) Patent No.: US 11,565,372 B2
(45) Date of Patent: Jan. 31, 2023

(54) DRY TO WET ABRASIVE BLAST MACHINE CONVERSION KIT AND METHOD

(71) Applicant: Cleaner Blast, LLC, Gonzales, LA (US)

(72) Inventor: Jerry L. Fenley, Jr., Gonzales, LA (US)

( * ) Notice: Subject to any disclaimer, the term of this patent is extended or adjusted under 35 U.S.C. 154(b) by 254 days.

(21) Appl. No.: 17/071,521

(22) Filed: Oct. 15, 2020

(65) Prior Publication Data

US 2021/0046608 A1 Feb. 18, 2021

Related U.S. Application Data

(63) Continuation-in-part of application No. 16/540,798, filed on Aug. 14, 2019.

(51) Int. Cl.
*B24C 3/06* (2006.01)
*B24C 7/00* (2006.01)

(52) U.S. Cl.
CPC ..... *B24C 3/06* (2013.01); *B24C 7/0038* (2013.01); *B24C 7/0046* (2013.01)

(58) Field of Classification Search
None
See application file for complete search history.

(56) References Cited

U.S. PATENT DOCUMENTS

| | | | | |
|---|---|---|---|---|
| 4,517,774 | A * | 5/1985 | Dudding | B24C 11/005 451/99 |
| 9,393,672 | B2 * | 7/2016 | Eliason | B24C 7/0038 |
| 9,925,642 | B2 * | 3/2018 | Eliason | B24C 7/0015 |
| 10,537,979 | B2 * | 1/2020 | Skross | B24C 7/0076 |
| 10,875,151 | B2 * | 12/2020 | Grau | B24C 7/0084 |
| 2022/0241930 | A1 * | 8/2022 | Nguyen | B24C 7/0046 |

* cited by examiner

*Primary Examiner* — Christopher W Fulton
(74) *Attorney, Agent, or Firm* — Williams Intellectual Property; Benjamin F. Williams

(57) ABSTRACT

A dry to wet abrasive blast machine conversion kit and method usable to convert an existing blast pot configured for sand blasting for use in wet abrasive air blasting includes a multi-function fluid manifold, and a control panel attachable to the blast pot to effectuate a first hydraulic circuit, a second hydraulic circuit, and a pneumatic circuit. The dry to wet abrasive blast machine conversion kit installs to the existing blast pot as is, and therefore enables conversion for wet abrasive blasting without additional penetrations through the blast pot envelope which might otherwise compromise manufacturer warranty and use ratings.

16 Claims, 13 Drawing Sheets

DRY TO WET ABRASIVE BLAST MACHINE CONVERSION KIT AND METHOD

CROSS-REFERENCE TO RELATED APPLICATIONS

This application is a continuation-in-part of application Ser. No. 16/540,798 filed on Aug. 14, 2019,

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Abrasive blasting (also known as "sand blasting") is well established in the art. Sand-sized particles are drawn from a blast pot into a blast stream of pressurized air and ejected from a nozzle of a blast hose to scour surfaces. While effective for restoring surfaces by removing the outermost layer, removing dirt, corrosion, oxides, paint, and other surface contaminants, sand blasting produces a dust that presents a health hazard for those operating the blasting equipment and others active in the vicinity. Under best is practices, pilots performing sand blasting operations are typically required to don protective clothing, including respirators to safeguard against respiratory inflammation and pulmonary diseases such as silicosis. Further, since dust is airborne, sand particulates produced at pressure into the ambient environment during sand blasting operations tend to travel farther than intended and settle to cover work areas. This requires a second round of cleaning to remove the sand particulates as well as any surface particulates that have inadvertently been airborne during scouring operations. Wet abrasive blasting is preferable to sand blasting in most instances, since use of a non-compressible fluid, such as water, maintains particulates in-stream and captures surface particulates scoured from the surface to wash away with outflow and cleaning effluents. In typical wet abrasive blasting operations, water is pumped into the blast pot along with sand-sized grit particles. The blast pot is pressurized and a slurry is introduced into a blast stream airflow for forcible ejection of the slurry out of a blast hose. Surface cleaning and scouring therefore occurs in much the same capacity as in dry abrasive blasting, however the slurry remains heavier than air and serves to capture particulates and route cleaning effluents away from the work area. This prevents formation of dust clouds and airborne particulates and provides for rinsing operations concurrent with surface cleaning, as well as operation of an alternate rinse cycle providing water to further remove slurry and cleaning effluents from the targeted surface and/or workspace. Slurry, being lubricated by the water, further decreases wear of the blast hose and its associated valves relative to dry abrasive blasting operations and, therefore, reduces frequency of replacement parts and servicing maintenance. Clearly, wet abrasive blasting is to be preferred.

The present invention, then, has been devised to enable conversion of a dry blast pot for use in wet abrasive blasting. The present dry to wet abrasive blast machine conversion kit has been devised to readily convert a dry blast pot used in sand blasting for use in wet abrasive blasting without requiring additional penetrations into the blast pot envelope whereby existing ratings (such as safety and use ratings by the American National Standards Institute ("ANSI") or the American Society of Mechanical Engineers ("ASME"), among other professional, trade, and manufacturing regulators) may be maintained.

The present invention, therefore, provides an expedient means of converting an existing dry blast pot for use in wet abrasvie blasting with minimal alterations to the existing equipment while providing for a remote rinse cycle and manual controls controlling blasting and rinse operations by a pilot directly from the blast hose nozzle.

FIELD OF THE INVENTION

The present invention relates to surface cleaning operations and equipment, and particularly to a dry to wet abrasive blast machine conversion kit employable to convert existing dry blast pots for use in wet abrasive blasting operations with minimal adaptation and without compromising the structural integrity of the blast pot or voiding approved manufacturer or usage ratings and/or warranties.

SUMMARY OF THE INVENTION

The present dry to wet abrasive blast machine conversion kit and method has been provided to enable ready conversion of an existing blast pot used for dry abrasive blasting (also "sand blasting") with minimal adaptation and without penetrating the blast pot anew whereby the structural integrity of the blast pot is ensured and applied manufacturer and usage ratings, such as ratings by the ASME and the ANSI and other trade and professional standards monitoring organizations, will not be compromised. The present dry to wet abrasive blast machine conversion kit enables a convenient means to transform existing sand blasting machines and apparatuses into preferential wet abrasive machines and apparatuses for wet abrasive blasting operations.

The present dry to wet abrasive blast machine conversion kit and method, therefore, makes use of the existing penetrations in an existing dry blast pot to enable use storing liquid under pressure and conveying a slurry to a blast stream for wet abrasive blasting operations. Internal piping used in sand blasting is removed from the interior of the blast pot. A multi-function fluid manifold is installed into the existing air pressure release aperture penetrating the blast pot. The multi-function fluid manifold includes a fluid inlet manifold, having a fluid inlet valve, by which fluid (typically water) is introducible into the pot interior when connected via a fill line to an associated water source. The multi-function fluid manifold also includes a pressure release valve to enable pressure release from the pot when necessary. The multi-function fluid manifold installs readily into the existing air pressure release aperture piercing the existing blast pot envelope without having to introduce additional penetrations in the blast pot envelope. Thus, no additional penetration of the blast pot is required to situate the multi-function fluid manifold to the blast pot for use in filling the blast pot.

The air pressure release aperture is typically situated upon blast pots proximal the top of the said pot, whereby emergency release of pressure is vented upward and away from surrounding articles and persons as may be present in the workspace. This makes installation of the multi-function fluid manifold convenient and situates the multi-function fluid manifold proximal the top of the pot. A pot pressure gauge may be included upon the multi-function fluid manifold to signal the pressure attained inside the pot to the pilot or user.

In one embodiment, the multi-function fluid manifold further includes an air purge riser disposed interiorly within the pot. The air purge riser is essentially a pipe vent projected upwardly to reach proximal an uppermost point within the blast pot interior. The air purge riser, therefore, includes an upper end disposed to project proximally to an uppermost point interior to the pot whereby air may be purged from the pot via displacement when filling the pot with fluid and when pressurizing the pot for use in blasting operations. This "high point bleed" is vitally important in evacuating unwanted air (and thus voids) from the pot interior when establishing pressure for wet air blasting.

In at least one alternate embodiment, the air purge riser may instead be incorporated into a pop-up gasket installed in the uppermost aperture of the blast pot, as will be described subsequently.

The pop us gasket is disposed to seal the pot when the pot is pressurized. Seated in an uppermost aperture extant in the blast pot, the pop-up gasket drops from the uppermost aperture when pressure inside the pot is equilibrated with ambient pressure but is prevented from falling into the pot by action of a stopper, disposed upon a shaft and projected from the pop-up gasket above the blast pot, to prevent passage into the pot interior. When the pot is pressurized, the pop-up gasket is forced to seat a plunger portion into the uppermost aperture, to effectively seal the uppermost aperture from within the pot. Thus, the pot may be filled with sand and/or grit or other particulate matter when the pot pressure is equal to the ambient pressure by pouring said particulates through the uppermost aperture. When the pot is pressurized, the uppermost aperture automatically closes by action of the pop-up gasket seating thereinto.

In the at least one embodiment wherein the air purge riser is incorporated into the pop-up gasket, the pop-up gasket also functions as the air purge to evacuate unwanted air from inside the pot during filling and when pressurizing the pot. In this particular embodiment, the air purge riser includes at least one arcuate member disposed in open communication with a vent stack disposed through the shaft of the pop-up gasket. The vent stack includes a lowermost end disposed through the pop-up gasket to project interior to the pot. The arcuate member is disposed projected from the lowermost end of the vent stack, in open communication therewith, to position an interior end in a position proximal to the uppermost point interior to the blast pot. A small block valve is disposed in operational communication with the air purge riser, which is closeable by action of a threshold pressure. Thus, air is displaced out of the air purge riser during filling of the pot and when pressurizing the pot whereby pressure interior to the pot acts upon the non-compressible fluid and particulates without encountering voids and air pockets.

A riser piping assembly is installed into an extant blast aperture disposed through the pot envelope, whereat the blast air is introduced during sand blasting operations, to serve as a drain while maintaining a desired water level interior to the pot. The riser piping assembly is a section of elbow piping disposed to project an end upwards to a height interior to the pot significant of a desired water level therein. Water is therefore drainable from the pot through the riser piping assembly, but only to a level corresponding to the height of the riser piping end interior to the pot. Thus, the water level interior the pot may be conveniently lowered to a desired height appropriate to accommodate a desired volume of grit into the pot interior whereby the water level is raised by equivalent displacement. This enables expedient refilling of the pot with a desired mixture of grit and water.

A slurry hose is connectable to an extant lowermost aperture of the blast pot whereat the blast hose is attached during dry blast operations. The slurry hose conveys slurry from the blast pot to the blast hose by way of a control panel, which control panel effectuates fill of the blast pot with water from an associated water source and controls blasting and rinsing operations, as will be described subsequently. The control panel supplies means for effectuating a first hydraulic circuit, a second hydraulic circuit, and a pneumatic circuit, as will be described subsequently.

The control panel houses means for mechanically routing fluid through each of a first hydraulic circuit and a second hydraulic circuit, for blast operations and operation of a rinse cycle, as will be described subsequently. The control panel also houses means for routing compressed air through a pneumatic circuit, for operation of the blast stream and, in at least one embodiment where such action is not effectuated electronically, establishment of a branched pneumatic control circuit to enable control between blasting operations and rinsing, as will be described subsequently.

The control panel is expediently attachable to the blast pot by means of attachment members that are, in at least one embodiment, configured to suspend the control panel from the top of the blast pot. The first hydraulic circuit supplies means for pumping water into the blast pot and from thence for introduction into the blast stream. The second hydraulic circuit enables operation of a rinse cycle, routing water without the blast pot. The pneumatic circuit forces compressed air to engage the blast stream and, in one embodiment, to provide for a control signal to control switching between said circuits.

The control panel contains mechanical pumps, valves, and actuators disposed in operational communication with manual controls remotely disposed upon a blast hose nozzle (or elsewhere remotely coupled for operative control), to enable control of said circuits to activate and deactivate the said circuits on and off, and for switching between the first and second hydraulic circuits to engage a rinse cycle remotely in lieu of blasting operations.

The panel, therefore, includes means for mechanically operating the first hydraulic circuit comprising a fill pump disposed to pump water from an associated water source into the blast pot via the multi-function fluid manifold; a fill pump check valve, to ensure unidirectional water flow into the blast pot; and a blast pump, disposed to pressurize the blast pot and force slurry through the slurry hose, through a panel slurry hose section within the control panel, for introduction into the blast stream. A slurry hose pinch valve is disposed in operational communication with the panel slurry hose section, actuated in at least one embodiment by an air pilot signal branched from the pneumatic circuit (as will be described subsequently) and controllable by the pilot operating the blast hose. The slurry hose pinch valve selectively pinches off the panel slurry hose section by action of clamp members devised to squeeze the hose closed. Since the pinch valve clamp members are situated exteriorly upon the panel slurry hose, and effectively compress the hose to cease slurry introduction into the blast stream, the clamp members never come into direct contact with the slurry stream thereby reducing wear from contact exposure to the passage of grit. The panel slurry hose section terminates at a juncture with a panel blast pipe section proximal a blast hose attachment aperture disposed exteriorly upon the control panel upon an outlet side.

Means for mechanically operating the second hydraulic circuit include the blast pump operative also in the first hydraulic circuit; a rinse shut off valve, to manually disable the rinse cycle when necessary; and a rinse water solenoid valve having an actuator disposed in operational communication with, in at least one embodiment, the air control signal operative in the pneumatic circuit, as will be described subsequently. The rinse water solenoid valve is operative to open the second hydraulic circuit whereby water from the water source is caused to flow through the second hydraulic circuit excluding the blast pot whereby water is introducible into the blast stream without slurry. As will be shown in the drawings accompanying the present disclosure, the second hydraulic circuit terminates at the panel blast pipe in a position separate from the panel slurry hose, whereby cessation of the first hydraulic circuit in preference of the second hydraulic circuit yields water from the blast hose without first having to discharge quantities of slurry remaining in the slurry hose upstream of the pinch valve. Thus, once the blast hose has been discharged of all slurry, rinse water is available upon demand. The rinse water solenoid valve is likewise operable by a pilot by manual controls disposed upon the blast hose nozzle whereby the pilot may switch between blast and rinse cycles from operative position at the blast hose nozzle.

Means for operating the pneumatic circuit include an air inlet connection aperture, disposed on an inlet side of the control panel, for attachment of an air hose to convey pressurized airflow into the panel blast pipe for conveyance to the blast hose attached at the blast hose attachment aperture on the outlet side of the panel. Compressed air is fed through an air-filter regulator to regulate the air pressure within a branch pneumatic control circuit branched from the blast stream in one embodiment of the instant invention, to enable actuation of the first and second hydraulic circuits and to control blasting and rinsing cycles.

Air conveyed through the branch pneumatic control circuit is fed through a second pneumatic control line port to a control line connected to a deadman handle upon the blast hose nozzle. Air is fed back from the deadman handle to a third pneumatic control port disposed upon the control panel. A rinse signal may be conveyed from the deadman handle to actuate the rinse water solenoid valve and engage the rinse cycle, which simultaneously actuates the slurry hose pinch valve to disable introduction of slurry into the blast stream.

It should be noted that the present disclosure contemplates an alternative embodiment wherein the branch pneumatic control circuit is replaced by an electrical circuit to effectuate the actuators controlling the rinse water solenoid valve, the slurry hose pinch valve, and to actuate and de-actuate the blast cycle electrically instead of pneumatically. For a more detailed discussion of the remote rinse control set forth herein, in both pneumatic and electrical embodiments, please see the parent patent application to this continuation-in-part application, U.S. patent application Ser. No. 16/540,798, which more fully details this novel methodology, and which is herein incorporated in its entirety by reference.

The control panel is a standalone unit that is conveniently attachable upon the blast pot by action of a pair of attachment members. The pair of attachment members enable installation of the control panel to the blast pot itself, to locate the panel proximal to the blast pot, and provide for interconnection therewith to route slurry, water, and air through each of the respective circuits the control panel enables. Interconnection of the slurry hose and the blast hose, as well as the pneumatic control lines (or, alternatively in some embodiments, electrical control lines), and the fill lines with the multi-function fluid manifold, thence enables blasting and rinsing operations drawn from slurry in the pot. Connection of the fill line to a water source enables filling of the blast pot with water.

The control panel, therefore, is readily attachable to the blast pot to enable alternative use in wet abrasive air blasting operations with minimal adaptations required. The existing blast pot is essentially used as is, subsequent removal of the internal piping used in sand blasting. No additional penetrations to the blast pot envelope are required and the retrofitting to accommodate the multi-function fluid manifold, the control panel, slurry hose, and blast hose is minimal.

Thus, has been broadly outlined the more important features of the present dry to wet abrasive blast machine conversion kit so that the detailed description thereof that follows may be better understood and in order that the present contribution to the art may be better appreciated.

Objects of the present dry to wet abrasive blast machine conversion kit, along with various novel features that characterize the invention are particularly pointed out in the claims forming a part of this disclosure. For better understanding of the dry to wet abrasive blast machine conversion kit, its operating advantages and specific objects attained by its uses, refer to the accompanying drawings and description.

BRIEF DESCRIPTION OF THE DRAWINGS

Figures

DETAILED DESCRIPTION OF THE DRAWINGS

With reference now to the drawings, and in particular FIGS. 1 through 12 thereof, example of the instant dry to wet abrasive blast machine conversion kit and method employing the principles and concepts of the present dry to wet abrasive blast machine conversion kit and method and generally designated by the reference number 10 will be described.

Figure 1:
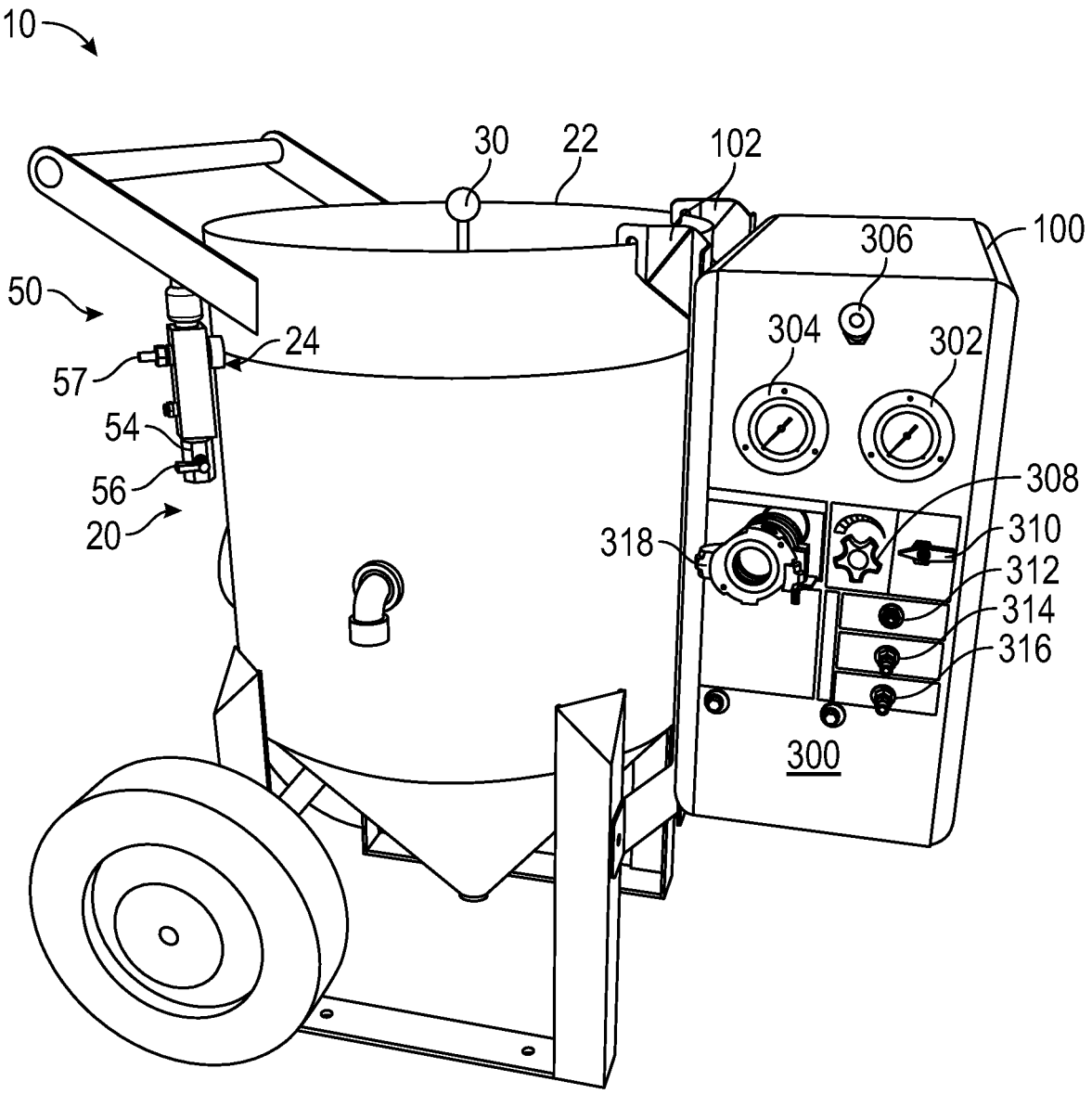
FIG. 1 is a side elevation view of an example embodiment of a control panel and multi-function fluid manifold disposed installed upon an existing blast pot to convert said blast pot for use in wet abrasive blasting operations.

FIG. 1 illustrates an example embodiment of the present dry to wet abrasive blast machine conversion kit 10 installed upon an existing dry blast pot 20. The pop-up gasket 30 is shown visibly projecting up above the top rim 22 of the blast pot. The multi-function manifold 50 is shown installed into the existing pressure-release valve aperture 24 disposed through the blast pot 20 envelope. The multi-function fluid manifold 50 includes a pressure-release valve 52, a fluid inlet manifold 54, having a fluid inlet valve 55 disposed therein, for interconnection with a fill line to introduce water, pumped via the control panel 100 from an associated water supply (not shown), into the blast pot 20. A manual shut off control 56 is disposed at the inlet manifold 54 to manually disable introduction of fluid into the pot 20 when desired.

Disposed suspended from the top rim 22 of the blast pot 20 is the control panel 100, attached to the blast pot 20 by means of a pair of attachment members 102 devised to engage to the top rim 22 of the blast pot 20. In FIG. 1, the outlet side 300 of the control panel 100 is visible. (The outlet side 300 of the control panel 100 is shown in greater detail in FIG. 7.) A pressure gauge 302 configured to show pressure attained interior to the blast pot 20, and a blast pressure gauge 304 configured to signal the pressure of the blast stream, are disposed upon the control panel outlet side 300. Emergency stop button 306 enables rapid deactivation of all blasting and rinsing operations by ceasing the pneumatic circuit, which, absent pressure upon the slurry hose pinch valve 416 actuator, simultaneously effectuates action of the slurry hose pinch valve 416 (see FIG. 9). A manual control 308 is disposed to operate the grit metering control valve 438 and thereby control metering of grit entering the blast stream. A blast pump switch 310 is also disposed upon the outlet side 300 to enable manual activation and deactivation of the blast pump 424 for engaging the first and second hydraulic circuits. (For presentation of the components internal to the control panel 100, please see FIG. 9 and description infra.)

Also disposed upon the outlet side 300 of the control panel 100 are pneumatic control ports 312, 314, 316 for connection of control lines feeding to manual controls 604 disposed upon the deadman handle 602 of the blast hose 600. The first pneumatic control line port 312 enables connection to the deadman handle 602, to effectuate actuation of the remotely controlled rinse cycle; the second pneumatic control line port 314 enables connection to the deadman handle 602, to convey supply air thereto for engaging the rinse cycle; and the third pneumatic control line port 316 enables connection to the deadman handle 602 to convey return air therefrom, to complete the branched pneumatic control circuit. Blast hose attachment aperture 318 enables connection of the blast hose 600 proper with the panel blast pipe 402 for blasting operations.

Figure 2:
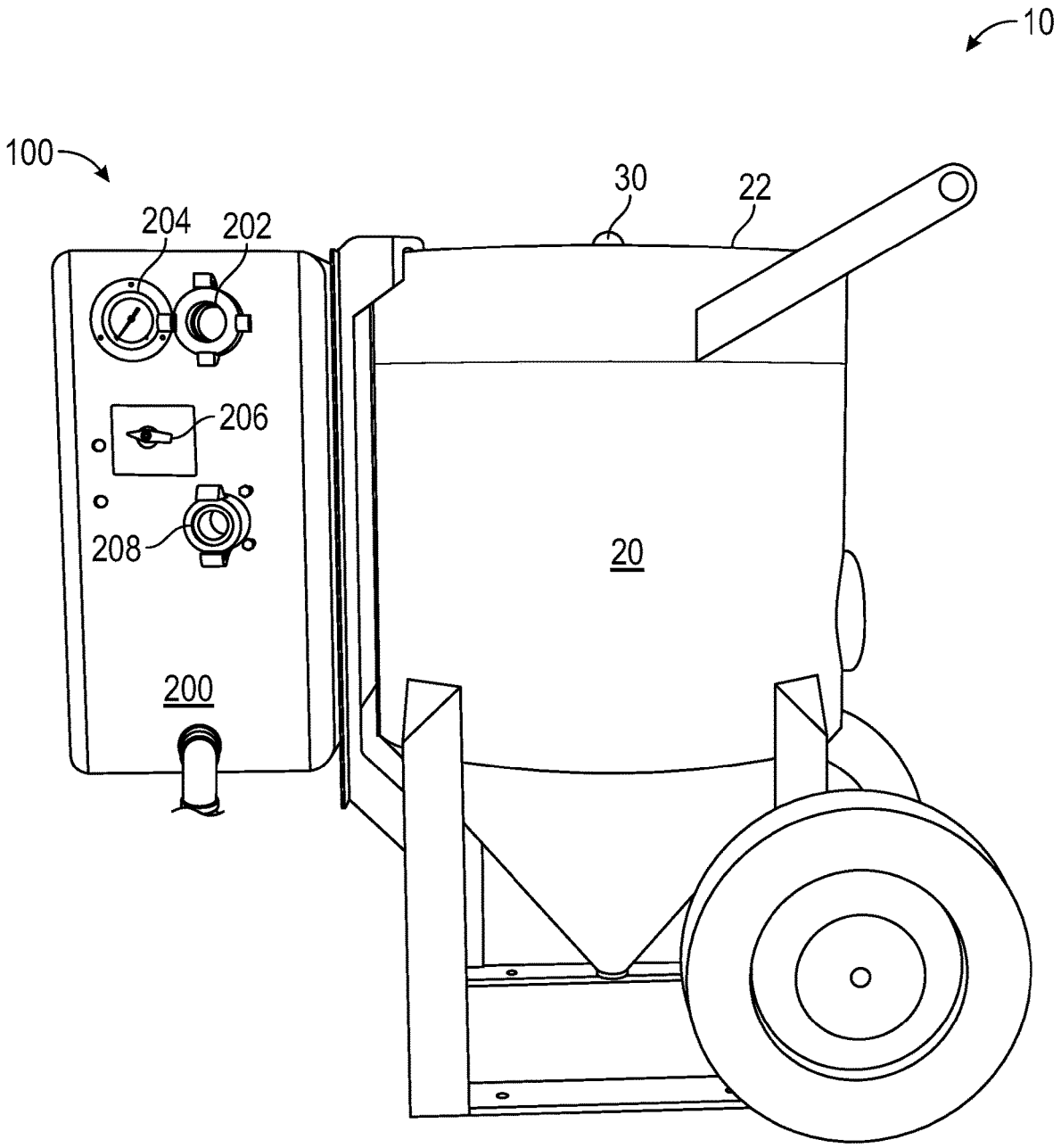
FIG. 2 is a side elevation view of an example embodiment of the control panel installed upon the blast pot showing an inlet side of the panel.

FIG. 2 illustrates the control panel 100 attached to the blast pot 20 with the inlet side 200 shown. (The inlet side 200 of the control panel 100 is shown in greater detail in FIG. 8.) The inlet side 200 of the panel 100 includes a connection port 202 to the main blast air inlet valve 404 for interconnection with an air hose (not shown) conveying air from a compressed air supply (not shown). Blast inlet pressure gauge 204 provides a readout of pressure of the airstream entering the panel blast pipe 402 routing air to the blast hose 600 connected at the outlet side 300. Water fill line connection aperture 208 enables interconnection with a fill line disposed to connect to the multi-function fluid manifold 50 to introduce water into the blast pot 20 and water supply line connection aperture 210 enables interconnection with a supply line disposed to convey water from an associated water supply. Air dump valve control 206 enables manual release of air pressure from the panel blast pipe 402.

Figure 3:
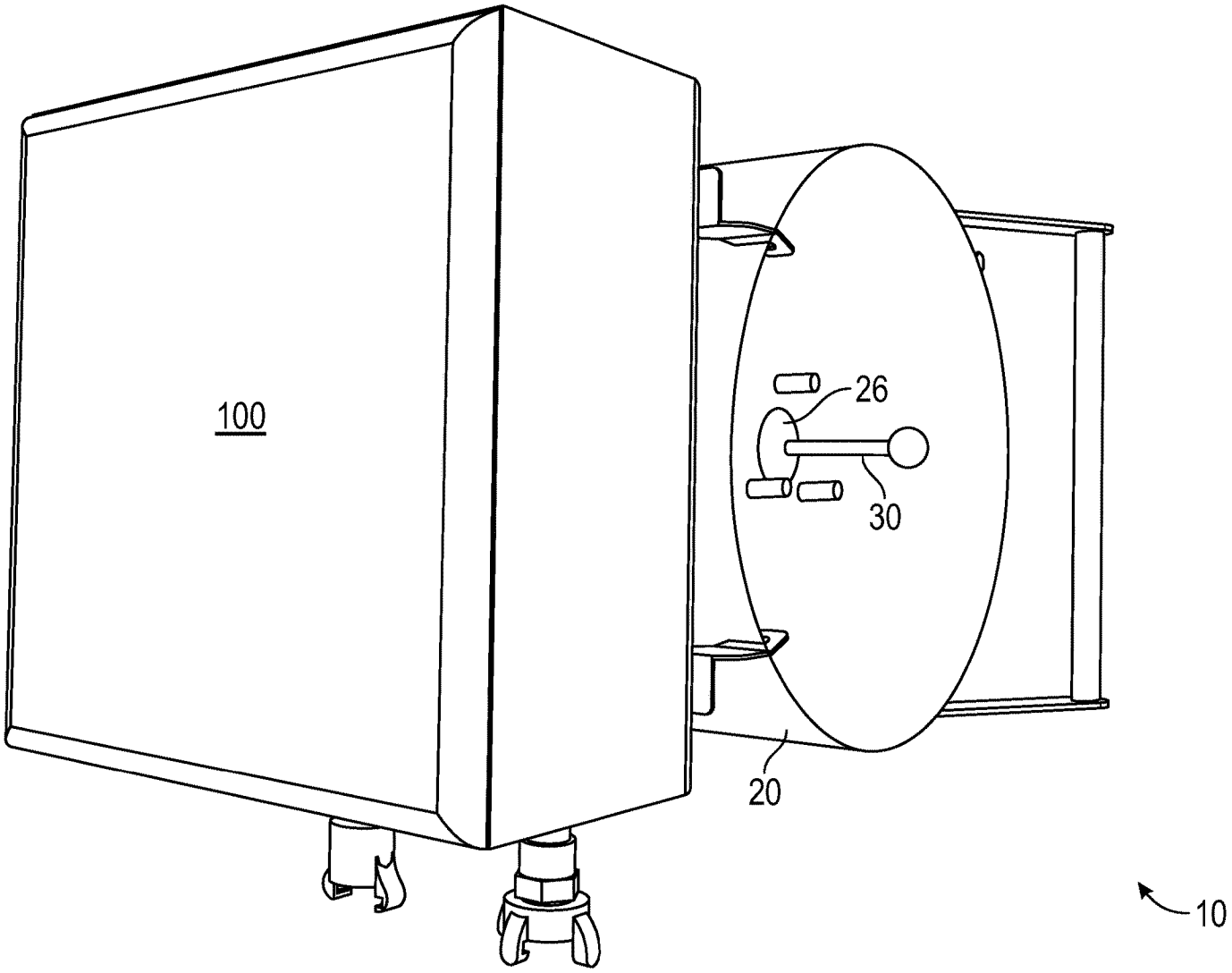
FIG. 3 is a raised elevation view of an example embodiment of the control panel installed upon the blast pot illustrating the pop-up gasket disposed operationally installed within an uppermost aperture of the blast pot.

FIG. 3 illustrates the top of the blast pot 20 and shows pop-up gasket 30 seated in the uppermost aperture 26 thereof. Pressure, attained interior to the blast pot 20, forces the pop-up gasket 30 to seat a plunger portion 32 into the uppermost aperture 26 and thus seal the uppermost aperture 26 during blasting and rinsing operations. In another example embodiment (depicted in FIGS. 6, 11, and 12) the pop-up gasket 30 includes an air purge riser 70 disposed in open communication with an air vent stack 74 operatively coupled with the pop-up gasket 30. For more detailed discussion of the air purge riser 70 operatively coupled with the pop-up gasket 30, see FIGS. 11 and 12.

Figure 4:
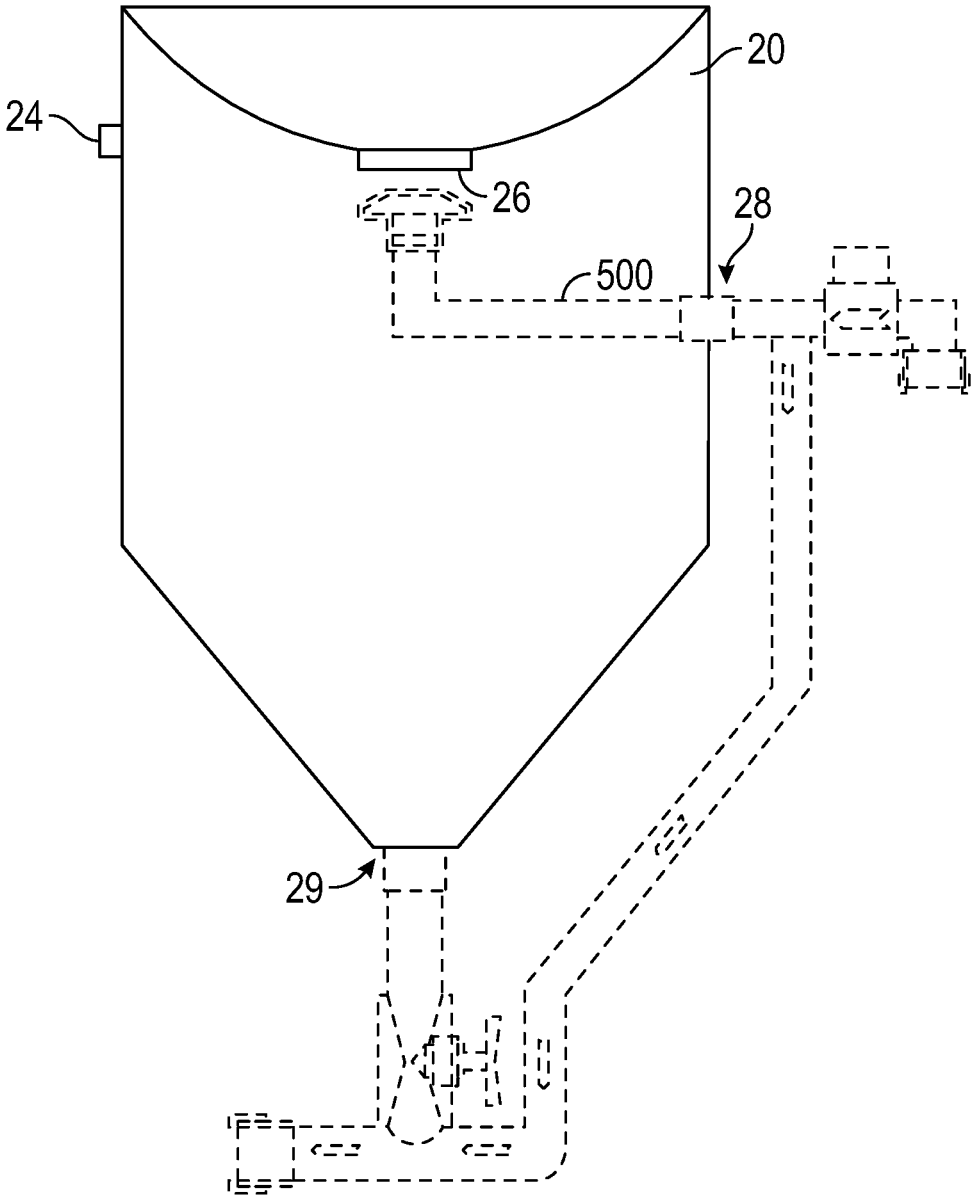
FIG. 4 is a diagrammatic view of an example embodiment of the existing blast pot with piping interiorly disposed for sand blasting. This piping is removed from the blast pop as part of the installation of the present control panel and multi-function fluid manifold to convert the blast pot for use in wet abrasive blasting operations.

FIG. 4 illustrates a diagrammatic view of an existing blast pot 20 configured for use in sand blasting. Internal piping 500, extant for use in sand blasting and illustrated in dashed lines, is removed from the interior of the blast pot 20 to reveal the upper most aperture 26, the pressure release aperture 24, the side aperture 28, and the lowermost aperture 29. No additional penetrations are required into the blast pot 20 envelope to install and operate the present conversion kit 10 to employ the existing blast pot 20 for use in wet abrasive blasting in lieu of sand blasting.

Figure 5:
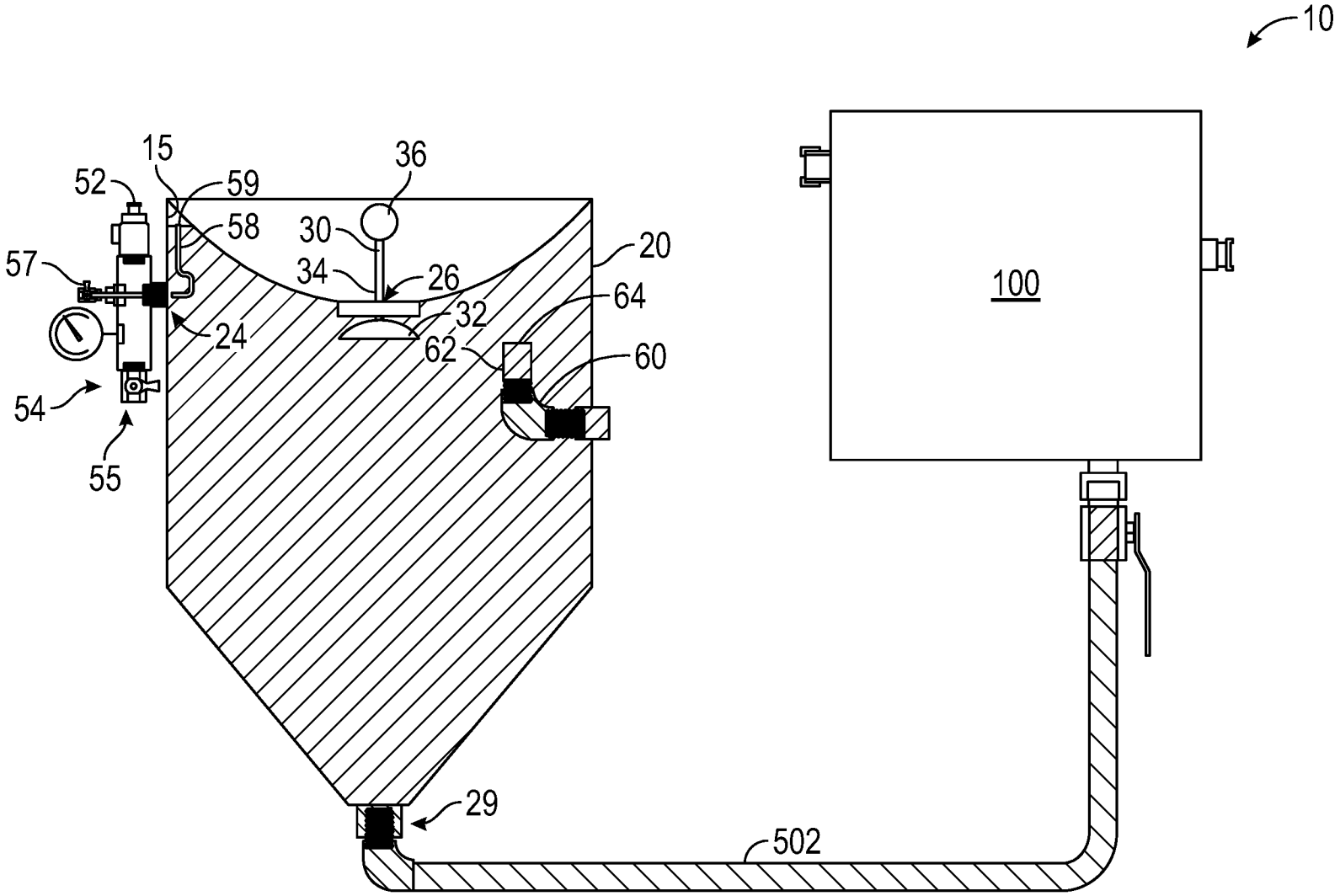
FIG. 5 is a diagrammatic view of an example embodiment of the control panel and multi-function fluid manifold installed to the blast pot illustrating an air purge riser disposed upon the multi-function fluid manifold to serve as a "highpoint" bleed.

FIG. 5 illustrates a diagrammatic view of an example embodiment of the present conversion kit 10 installed to the existing blast pot 20 of FIG. 4, once the internal piping 500 has been removed. In this example embodiment shown, a highpoint bleed is incorporated in the multi-function fluid manifold 50. Multi-function fluid manifold 50 is installed into the existing pressure release aperture 24 disposed in the blast pot 20. The multi-function fluid manifold 50 includes a fluid inlet manifold 54, disposed to enable directional flow of water into the blast pot 20 through a fluid inlet valve 55 disposed interiorly to the fluid inlet manifold 54; a pressure release valve 52, to vent pressure attained above a set threshold from inside the pot 20; and an air purge valve 57 enabling manual release of pressure attained within the pot 20 when desired. An air purge riser 58 is disposed interior to the pot 20 in open communication with the air purge valve 57. The air purge riser 58 includes an upper end 59 disposed situated proximal an uppermost point 15 interior to the blast pot 20, thereat to vent air from the uppermost reaches inside the pot 20 when filling with water and when pressurizing the pot 20. This critical function ensures that voids and airspaces are evacuated from the pot 20 previous to blasting operations, as the pot 20 is being filled and pressurized. This enables a complete fill of the pot 20. The air purge valve 57 may be configured to automatically close when a threshold pressure is reached, said threshold pressure significant of all air venting form the pot 20 interior or, alternatively, the air purge valve 57 may be operated manually as soon as pressure is attained and water is witnessed bleeding through the valve 57.

To enable controlled drainage of a particular volume of water, suited to displacement of fluid when grit is reintroduced interior to the pot previous to blasting operations, a riser piping assembly 60 is installed in the side aperture 28. The riser piping assembly 60 includes a vertical section 62 configured to project an upper end 64 to a certain height within the pot 20 interior. The riser piping assembly 60 enables drainage of water from the pot 20 to reduce the water level therein to a prescribed depth interior to the pot 20. Thus the riser piping assembly 60 may be opened to enable drainage of the water level inside the pot 20 to the prescribed level whereby addition of grid, sand, or other particulates and/or cleaning materials may be added to a known volume calculated to displace the water level, or add to the water level, back to fill the pot 20.

The pop-up gasket 30 is also shown in FIG. 5 having a plunger portion 32 disposed interior to the pot 20, and a shaft 34 and stopper 36. The pop-up gasket 30 is slidably disposed through the uppermost aperture 26 and is configured to rise under pressure to seat the plunger portion 32 into the uppermost aperture 26 to seal off the pot 20. When pressure is equilibrated inside the pot 20 relative ambient pressure outside the pot 20, the pop-up gasket 30 falls under gravity unseating the plunger portion 32 from engagement in the uppermost aperture 26, thereby opening the aperture 26 whereby grit, sand, or other particulate and/or cleaning materials may be added to the pot 20 interior. (In such an instance, drainage of the pot 20 to lower the water level to a prescribed height by action of the riser piping assembly 60 is useful, whereby a known quantity or volume of material may be added to the pot 20 to displace, or add to, the water level and thereby restore fullness of the pot 20.) Stopper 36, disposed endwise atop the shaft 34, may be employed to prevent fall of the pop-up gasket 30 through the aperture 26, into the pot 20.

The control panel 100 is shown connected to the blast pot 20 by a slurry hose 502, disposed at the lowermost aperture 29 of the pot 20, for routing slurry into the blast stream during blasting operations.

Figure 6:
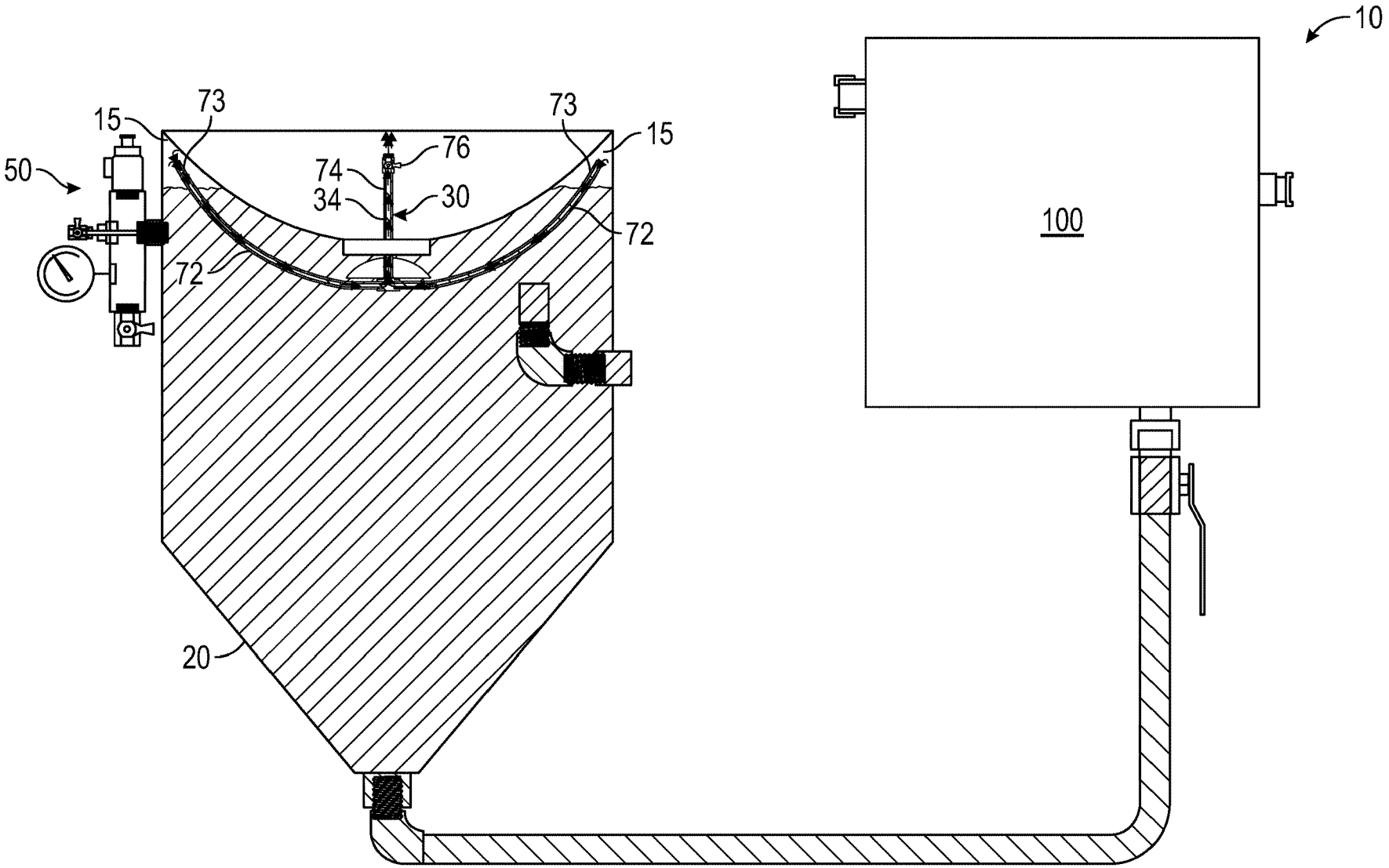
FIG. 6 is a diagrammatic view of an example embodiment of the control panel and multi-function fluid manifold installed on the blast pot with an air purge riser disposed instead in open communication with a vent stack disposed through the pop-up gasket to serve as the "highpoint" bleed.

FIG. 6 illustrates a diagrammatic view of an example embodiment of the present conversion kit 10 installed to the existing blast pot 20 of FIG. 4 once the internal piping 500 has been removed. In this example embodiment shown, distinct from the example shown in FIG. 5, the highpoint bleed is operatively coupled with the pop-up gasket 30 instead of with the multi-function fluid manifold 50. In this example embodiment, the multi-function fluid manifold 50 is identical to the multi-function fluid manifold 50 as described above, only it does not incorporate the air purge riser 58 or air purge valve 57 as shown in FIG. 5. Instead, in this example embodiment, the highpoint bleed is effectuated by action of a pair of arcuate members 72 disposed in open communication with an air vent stack 74 disposed through the pop-up gasket 30 shaft 34. Each of the pair of arcuate members 72 is disposed with a distal end 73 situated proximate to an uppermost point 15 interior to the blast pot 20, thereat disposed to vent air from the upper reaches of the pot interior, and thereby ensuring all air is vented previous to water being forced through the bleed. A block valve 76 is disposed upon the air vent stack 74 configured to close once a threshold pressure has been attained interior to the pot 20, said threshold pressure significant of all air being forced from the pot 20 interior. Alternatively, the block valve 76 may be engaged manually to close the highpoint bleed as soon as water is witnessed bleeding from the air vent stack 74.

Figure 7:
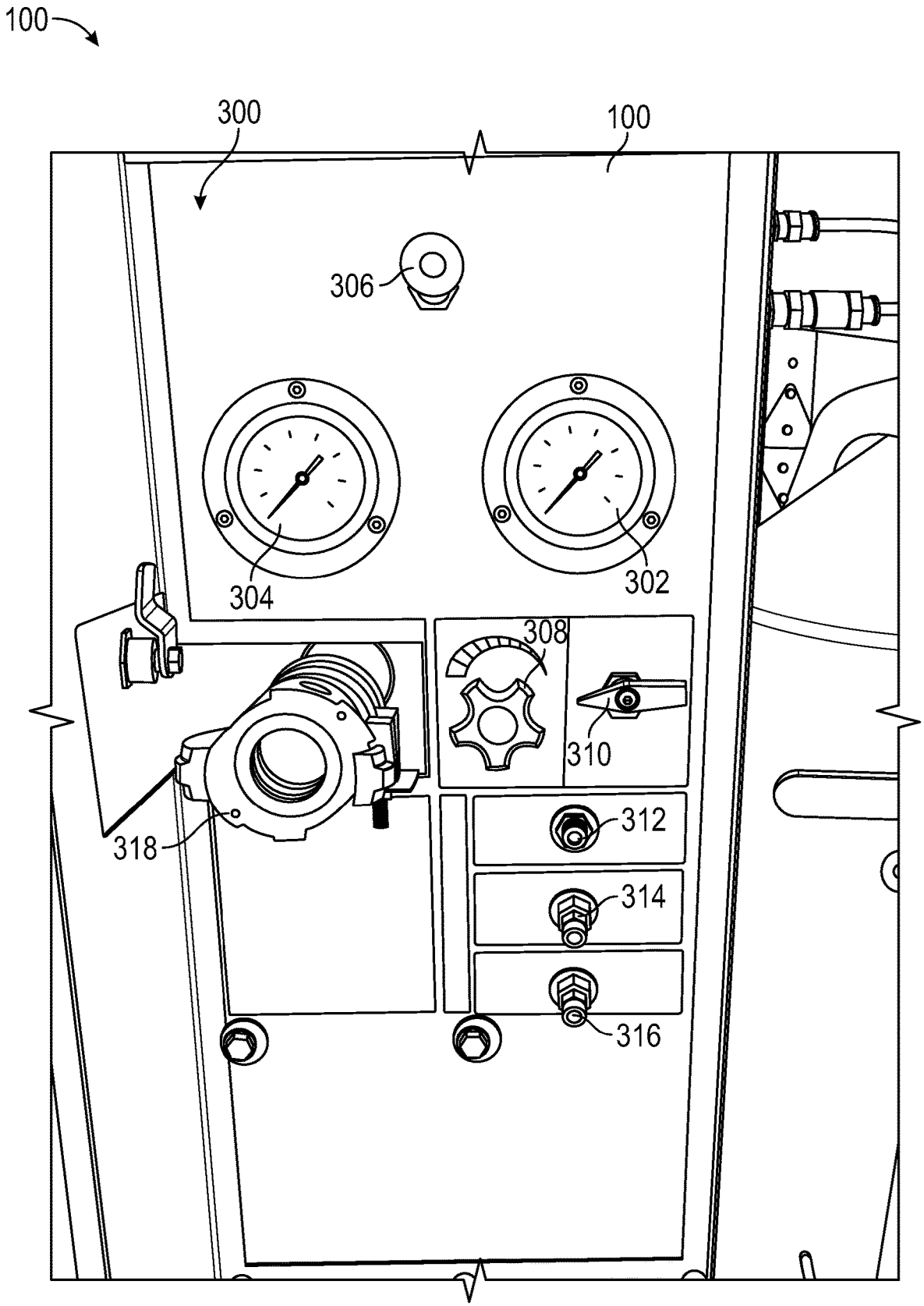
FIG. 7 is a detail view of an example embodiment of an outlet side of the control panel.

FIG. 7 is a detail view of the outlet side 300 of the control panel 100. Blast pressure gauge 304 and hopper pressure gauge 302 provide real time pressure readouts. Blast hose attachment aperture 318 interconnects the blast hose to the panel blast pipe for blasting operations. Grit metering valve manual control 308 enables selective control of sized particles entering the blast stream through the slurry hose 502. Blast pump switch 310 enables manual activation and deactivation of the blast pump 424 to prepare for initiating and ceasing blasting operations. Emergency stop button 306 enables immediate cessation of blasting operations by disengaging the blast stream and engaging the slurry hose pinch valve 416. The first pneumatic control line port 312 delivers the rinse signal from the deadman control handle 602 on the blast hose 600 nozzle when a manual rinse control 606 is engaged by the pilot. The second pneumatic control line port 314 delivers supply air to the deadman handle 602 for switching between blasting and rinse operations by action of the remote rinse control 606. The third pneumatic control line port 316 delivers return air from the deadman handle 602 to complete the branched pneumatic control circuit.

Figure 8:
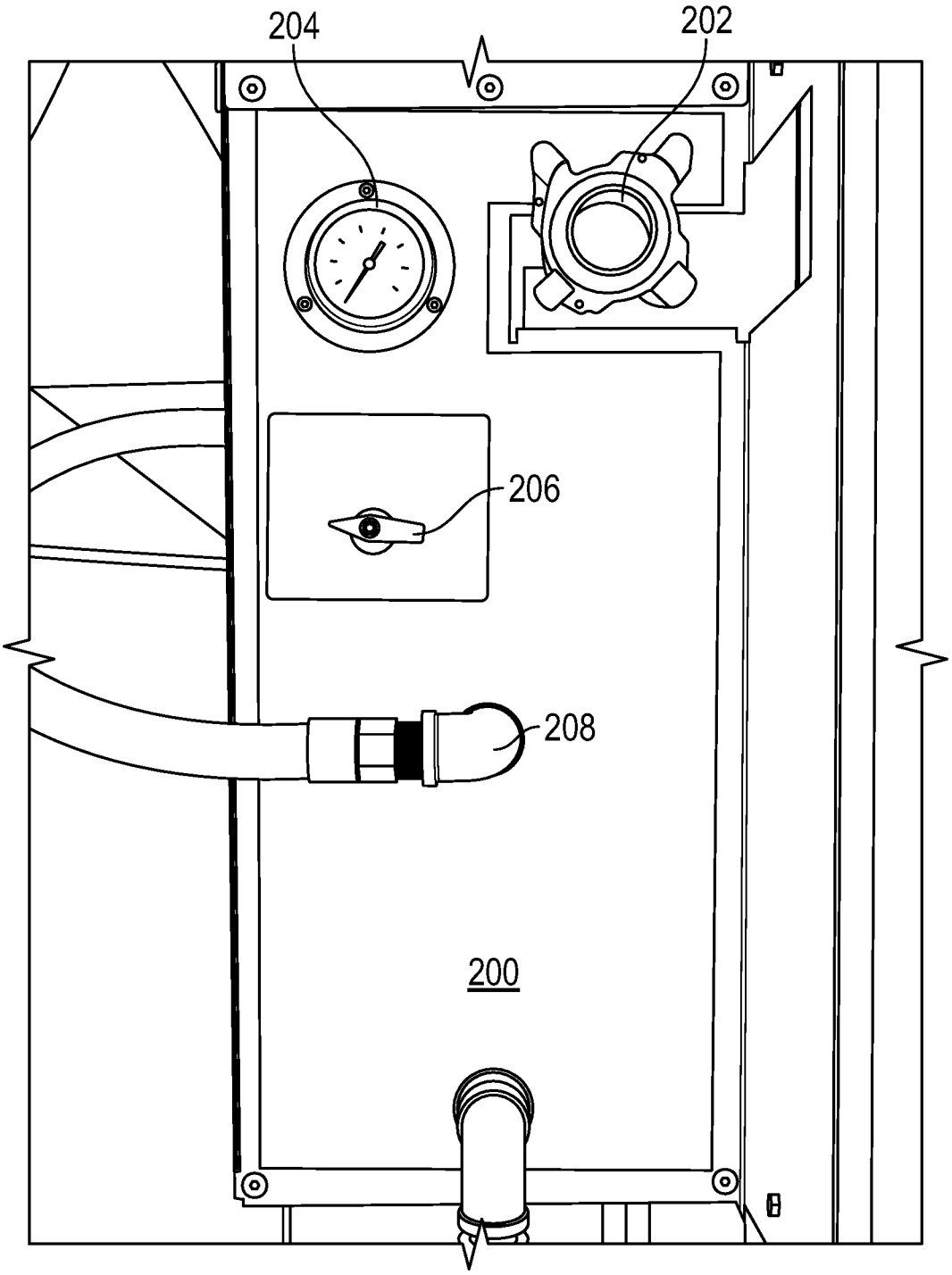
FIG. 8 is a detail view of an example embodiment of the inlet side of the control panel.

FIG. 8 is a detail view of the inlet side of the control panel, the principal features of which have already been discussed in reference to FIG. 2

Figure 9:
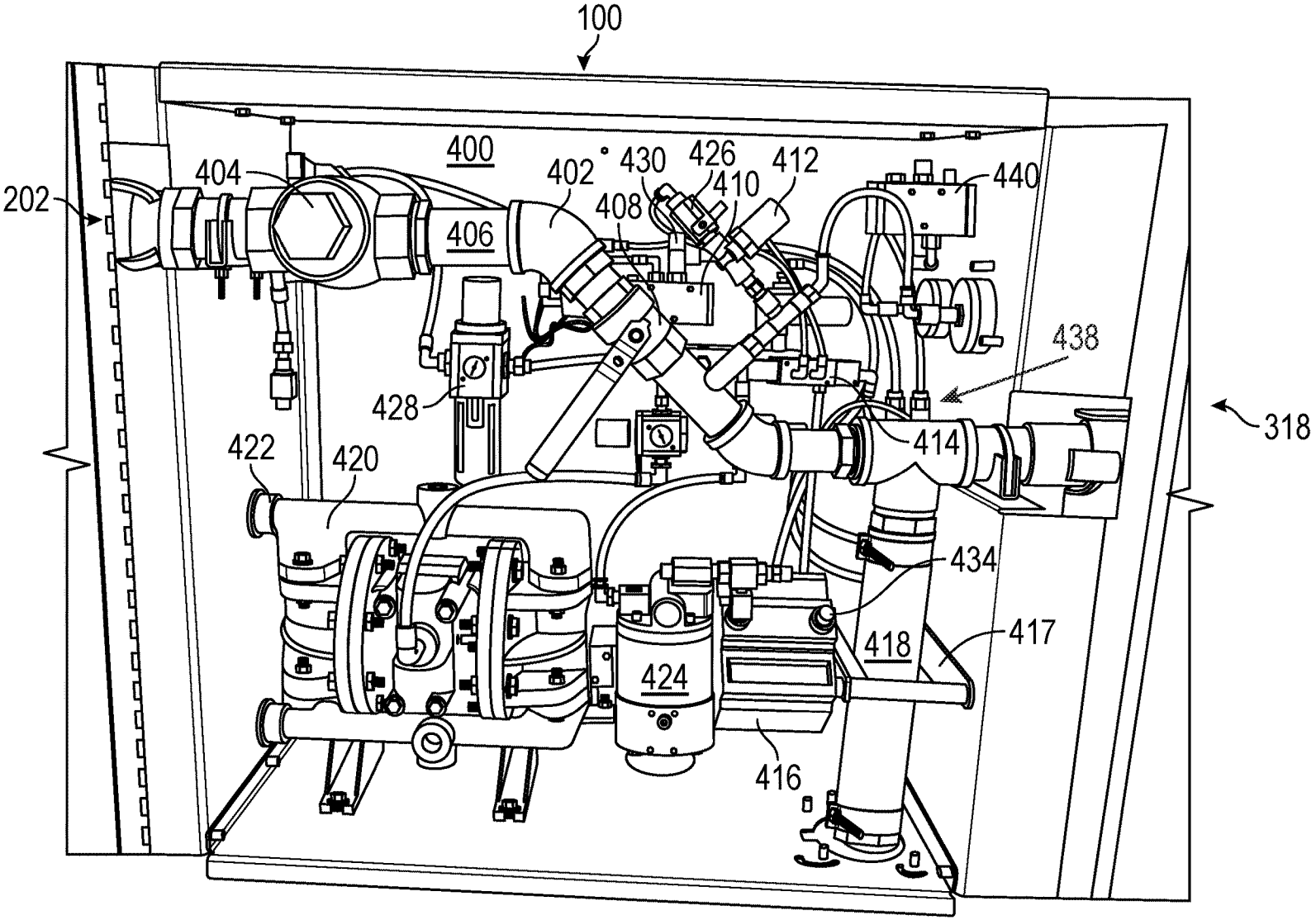
FIG. 9 is a detail view of an example embodiment of the control panel interior illustrating the means for effectuating each of a first hydraulic circuit, a second hydraulic circuit, and a pneumatic circuit.

FIG. 9 is a detail view of the interior 400 of the control panel 100. Connection port 202 on the inlet side 200 of the panel 100 introduces pressurized airflow from an associated air source (not shown) through panel blast pipe 402 to communicate with blast hose attachment aperture 318 disposed on the outlet side 300 of the panel 100. Main blast inlet valve 404 regulates airflow and main check air valve 406 ensures unidirectional flow. Blast pressure throttle valve 408 enables manual cessation of blast stream at the panel blast pipe 402. Main control valve-relay 410 is controllable by coordination of, in at least one embodiment where electrical means are not utilized, the air pilot control signal to actuate rinse water solenoid valve 412, rinse water valve-relay 414, and slurry hose pinch valve 416 to engage against the panel slurry hose section 418.

Fill pump 420 is a double-diaphragm pump used to pump water from an associated water source (not shown) into fill line 422 to introduce water into the blast pot 20. Blast pump 424 serves to pressurize the blast pot 20 and engender the first and second hydraulic circuits for blasting operations.

Main control valve-relay 410 functions as the main on-off control for the blast air cycle. In the example embodiment depicted, the main control valve-relay 410 is a pneumatic five-port, four-way, pneumatic air pilot controlled valve with one normally-closed and one normally-open port (not shown). When the deadman remote control handle 602 is squeezed by a pilot operating the blast hose 600 nozzle, air is routed through a branch circuit via an emergency stop valve 440 to an actuator upon the main control valve-relay 410. Pressurization by airflow incident this actuator causes the main control valve-relay 410 to actuate and switch airflow from a normally-open port to a normally-closed port, thereby enabling the blast cycle, as will be described subsequently.

Airflow through the normally-closed port of the main control valve-relay 410 sends a pilot signal to a branch circuit that controls the main blast air inlet valve 404 (to activate airflow through the pneumatic circuit) and concurrently instates a pilot signal at a normally-closed port of rinse control valve-relay 414. When this normally-closed port of rinse control valve-relay 414 is closed, the air pilot signal thereat is preempted.

Airflow introduced into the control circuit is likewise fed in parallel into rinse control valve-relay 414 from air filter-regulator 428. During blast operations, airflow is directed through a normally-open port inside rinse control valve-relay 414. Airflow through the normally-open port of rinse control valve-relay 414 is directed to actuate a pinch air block valve 430 disposed in fluid communication with the main control valve-relay 410 and the pinch valve 416 operative upon the panel slurry hose section 418. When actuated, the pinch air block valve 430 opens. When the pinch air block valve 430 is open, and airflow through the main control valve-relay 410 is active through the normally-closed port therein, airflow is exhausted through a pinch valve exhaust 434 to depressurize the branch circuit controlling the pinch valve 416, thereby ensuring the pinch valve 416 is open whereby the first hydraulic circuit is enabled. Thus, blasting operations are enabled when the deadman remote control handle 602 is squeezed (or activated).

Rinse control valve-relay 414 is actuated by a pilot signal diverted thereto by action of remote rinse control valve 436 disposed at the blast hose 600 nozzle (it is contemplated as within the scope of ordinary skill that the remote rinse control valve 436 be remotely located as well). Manual action at the remote rinse control valve 436 diverts airflow into a branch circuit to pressurize an actuator actuating the rinse control valve-relay 414 to switch airflow through the rinse control valve-relay 414 normally-closed port. When the normally-closed port of the rinse control valve-relay 414 is opened by the pilot signal sent from a remote rinse control valve 436, airflow pressurizes a branch circuit controlling rinse water solenoid valve 412 that enables waterflow through the second hydraulic circuit. Concurrently, airflow is preempted from the pinch air block valve 430 by closure of the normally-open valve in the rinse control valve-relay 414, preventing airflow therethrough, which thence causes closure of the pinch air block valve 430 and prevention of exhaust from the pinch valve control circuit. The pinch valve 416 is thus pressurized and actuates to cease the first hydraulic circuit by clamping the panel slurry hose section 418 closed by engagement between clamp members 417 to prevent throughflow of fluid therethrough. The rinse cycle is now enabled.

Switching between blast and rinse cycles is therefore effective immediately by an operator or pilot switching the remote rinse control valve 436. Pressure potential at both the first and second hydraulic circuits is uninterrupted. Pressure within the pneumatic circuit is uninterrupted. Only throughflow is ceased or enabled, thereby enabling immediate switching between blast and rinsing cycles.

Release of the deadman remote control handle 602 ceases blast operations—the main control valve-relay 410 switches airflow to the normally-open port whereby the pinch valve 416 is immediately actuated to cease throughflow of the first hydraulic circuit and airflow is not fed via the normally-closed port to actuate the main blast air inlet valve 404 thereby disabling the pneumatic circuit. For a more comprehensive description of the activities of the internal components above described, please review the parent application, U.S. patent application Ser. No. 16/540,798, from which this continuation-in-part claims priority.

Figure 10:
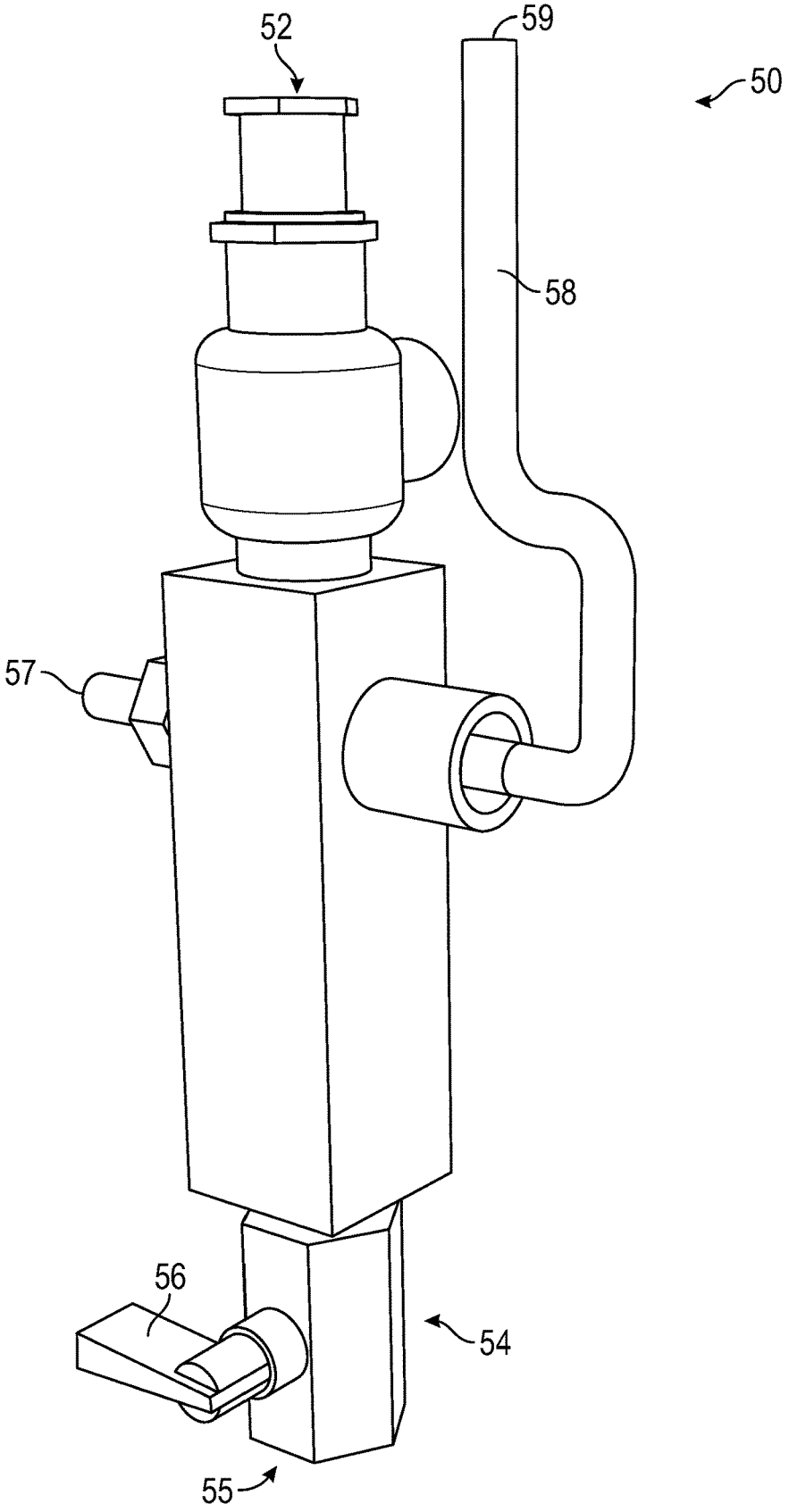
FIG. 10 is a detail view of an example embodiment of the multi-function fluid manifold having the air purge riser.

FIG. 10 is a detail view of an example embodiment of the multi-function fluid manifold 50. Fluid inlet manifold 54 includes a manual control to open and close the fluid inlet valve 55 disposed within the fluid inlet manifold 54. Pressure release valve 52 is disposed to release pressure upwardly should an interior pressure within the pot 20 exceed a threshold pressure. Air purge riser 70, configured to effectuate a highpoint bleed from the pot 20 interior, is disposed in open communication with the air purge valve 57 disposed to bleed air from the pot 20 when filling and pressurizing.

Figure 11:
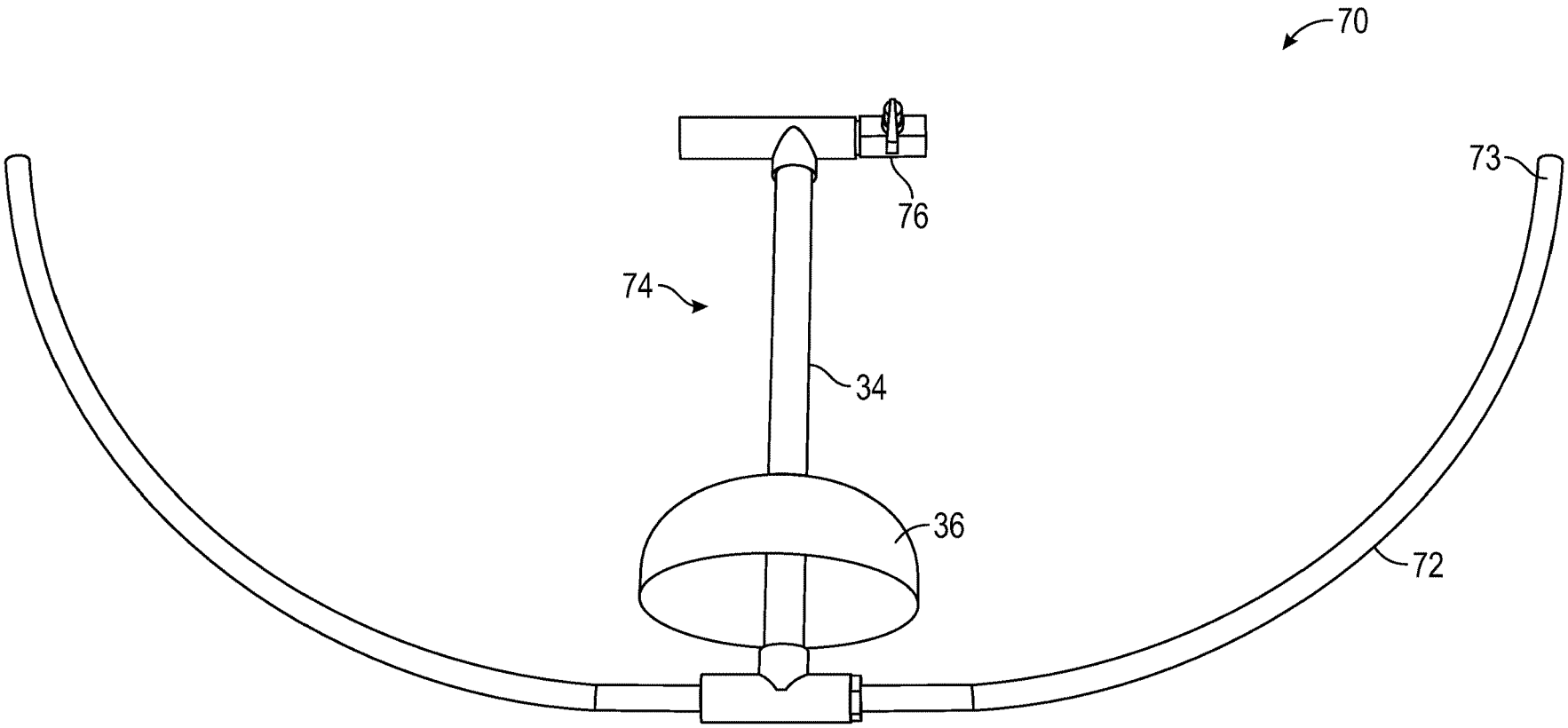
FIG. 11 is a detail view of an example embodiment of the air purge riser disposed in open communication with the vent stack disposed in operational communication with the pop-up gasket.

FIG. 11 is a detail view of an example embodiment of the pop-up gasket 30 and air purge riser 58 combination operatively coupled. At least one arcuate member 72 is disposed with a distal end 73 projected to bleed air from inside the pot 20 at the uppermost reaches therein. Each at least one arcuate member 72 is disposed in open communication with a vent stack 74 vertically disposed through the shaft 34 of the pop-up gasket 30. The highpoint bleed established inside the pot 20 in this embodiment, therefore, vents a highpoint bleed through the pop-up gasket 30. Block valve 76, disposed apically upon the air vent stack 74, is operational to automatically close off the highpoint bleed when a threshold pressure is reached inside the pot 20 or, alternatively, by manual engagement when water is witnessed to bleed therefrom.

Figure 12:
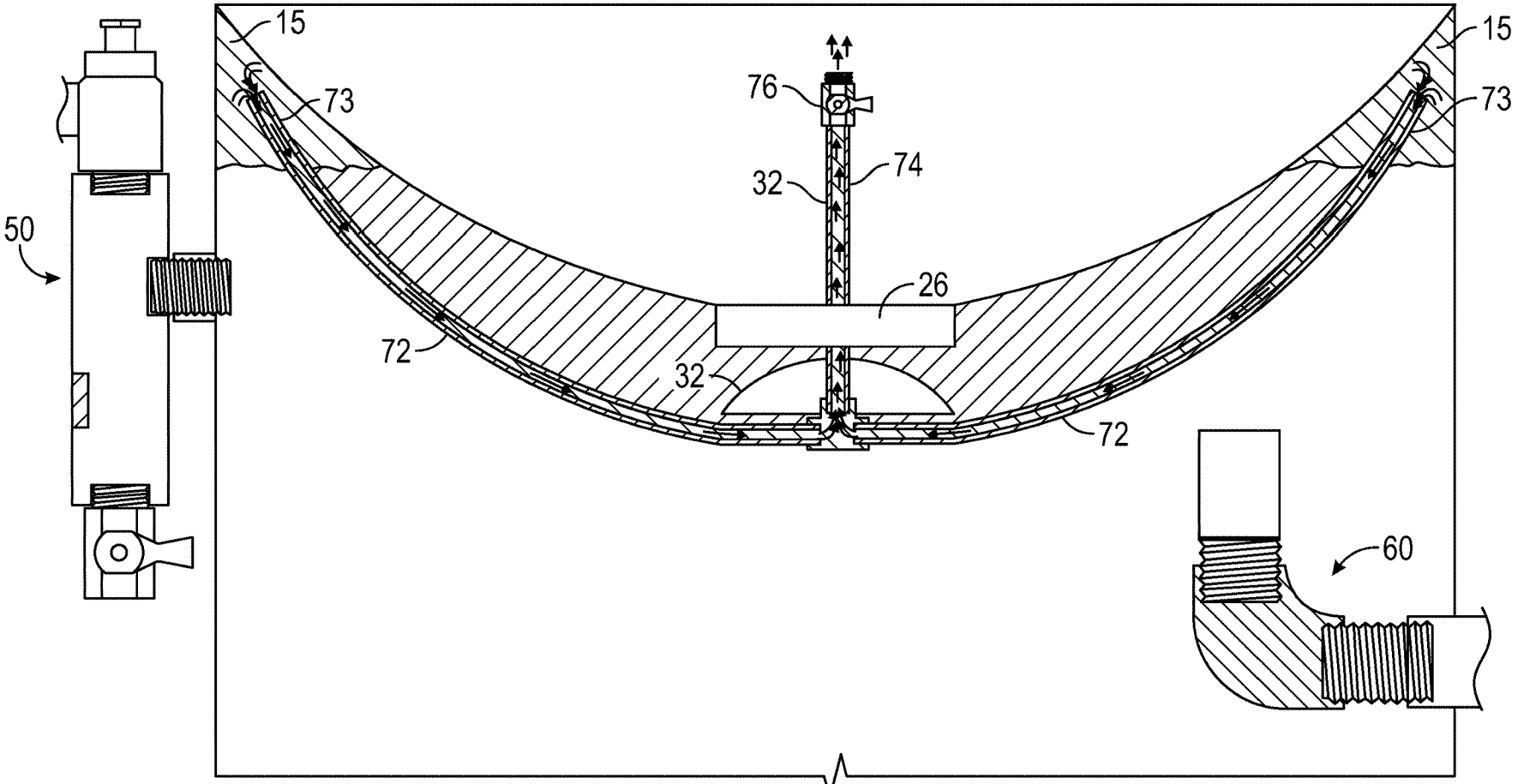
FIG. 12 is a detail in-use view of the example embodiment of the air purge riser shown in FIG. 11.

FIG. 12 is a detail in-use view of the example embodiment of the highpoint bleed discussed in regard to FIG. 11 wherein distal ends 73 of each at least one arcuate member 72 bleed air pockets from the uppermost reaches of the pot 20 interior to vent through the air vent stack 74 disposed operatively coupled with the pop-up gasket 30 plunger portion 32.

Figure 13:
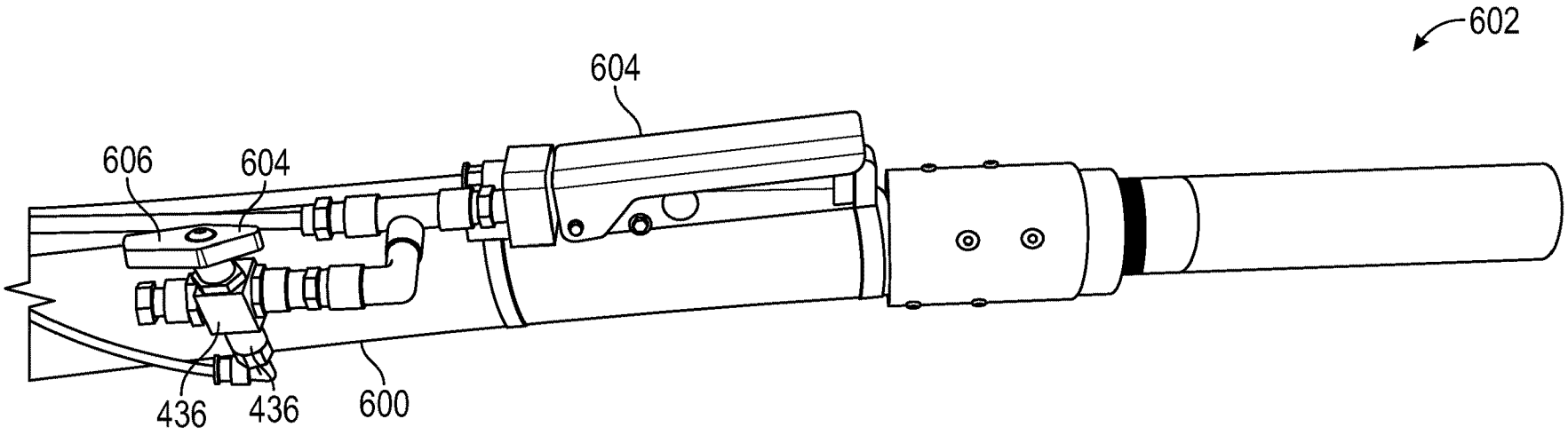
FIG. 13 is a detail view of an example embodiment of a blast hose deadman control handle.

FIG. 13 is a detail view of the deadman control handle 602 disposed at the blast hose 600 nozzle. Deadman handle 602 is depressible and must be depressed for blasting operations to occur. manual rinse control 606 enables switching between the first and second hydraulic circuits and, therefore, blasting operations and rinsing operations by a pilot directly at the blast hose 600 nozzle.

What is claimed is:

1. A method of converting an existing dry air blast pot for wet abrasive blasting without adding new holes to the blast pot, said method comprising the steps of:

removing existing piping disposed inside the blast pot for dry air blasting;

attaching a multi-function fluid manifold to an existing air pressure release aperture disposed in the blast pot, said multi-function fluid manifold comprising:

a fluid inlet valve;

a pressure release valve;

disposing a pop-up gasket within an existing upper opening of the blast pot, said pop-up gasket disposed to seal the upper opening when the blast pot is pressurized;

evacuating air from inside the blast pot through an air purge riser installable to vent air from the uppermost reaches of the blast pot interior while pumping fluid into the pot and alternatively when pressurizing the pot;

connecting a blast control panel in fluid communication with each of a slurry outlet installed upon the blast pot and the fluid inlet valve of the multi-function fluid manifold, said control panel devised to operationally control a first hydraulic circuit, a second hydraulic circuit, and a pneumatic circuit for blasting operations associated with the blast pot, said control panel comprising:

an air supply inlet;

a blast hose outlet connection;

a slurry hose connection port; and attachment members configured to attach the control panel to the blast pot;

wherein fluid is introducible into the blast pot via the multi-function fluid manifold and abrasive material is forcible under pressure from the blast pot to a blast stream maintained by pneumatic pressure supplied via the air supply inlet.

2. The method of claim 1 wherein the air purge riser is disposed in open communication with an air purge valve installed upon the multi-function fluid manifold, said air purge riser having an upper end disposed proximal to an uppermost point interior to the blast pot.

3. The method of claim 1 wherein the air purge riser includes at least one arcuate member disposed in open communication with the pop-up gasket, said at least one arcuate member oriented to purge air from an uppermost point interior to the blast pot, whereby air is ventable through a vent stack operatively coupled with the pop-up gasket until a block valve, disposed in operational communication with the vent stack, is closed.

4. The method of claim 3 wherein the block valve is closed automatically when pressure is attained interior to the blast pot sufficient to close the block valve.

5. The method of claim 1 further comprising the step of installing a riser piping assembly into a side aperture disposed upon the blast pot, said riser piping assembly including a vertical member disposed to enable draining of a fluid level from within the blast pot while maintaining a certain fluid level within the blast pot above a known depth.

6. A wet abrasive blast machine conversion kit devised for converting an existing blast pot from dry to wet abrasive blasting operations, and providing for remote rinse control, without any modifications made to the existing blast pot, said kit comprising:

a control panel attachable to the existing blast pot, said control panel comprising:

means for routing fluid through a first hydraulic circuit, said first hydraulic circuit disposed to enable blast operations;

means for routing fluid through a second hydraulic circuit, said second hydraulic circuit disposed to enable rinse operations; and means for routing air through a pneumatic circuit, said means for routing air through the pneumatic circuit including establishing an air control signal in a branch pneumatic control circuit directable to control operation of the first hydraulic circuit and the second hydraulic circuit, said branch pneumatic control circuit comprising a pilot signal directable upon a control valve relay, said control valve relay having:

a normally-open port directed to actuate a pinch air block valve disposed in fluid communication with a main control valve-relay and a pinch valve operative upon a slurry hose section;

a normally-closed port directed to a pinch valve exhaust that depressurizes the branch circuit and maintains the pinch valve in an open configuration; and a slurry hose connectable to the control panel, said slurry hose having a nozzle comprising a remote rinse control valve disposed to divert airflow within the branch pneumatic control circuit to pressurize an actuator upon the rinse control valve-relay to switch airflow from the normally-open port through the normally-closed port;

wherein switching between blast and rinse cycles is immediately effectible by a pilot manually at the nozzle of the slurry hose without any depressurization of the first hydraulic circuit, second hydraulic circuit, or pneumatic circuit.

7. The wet abrasive blast machine conversion kit of claim 6 further comprising a multi-function fluid manifold installable at an existing pressure release aperture disposed in an existing blast pot.

8. The wet abrasive blast machine conversion kit of claim 7 wherein the multi-function fluid manifold comprises:

a fluid inlet manifold;

a fluid inlet valve disposed within the fluid inlet manifold;

a pressure release valve;

an air purge riser;

an air purge valve disposed in operational communication with the air purge riser;

wherein installation of the multi-function manifold to a blast pot orients the air purge riser proximal a highest point interior to the blast pot whereby air may be purged from the blast pot interior while filling the blast pot with fluid and, alternatively, when the blast pot interior is pressurized.

9. The wet abrasive blast machine conversion kit of claim 8 wherein means for routing air through the pneumatic circuit:

an air inlet connection aperture connectable to an air inlet hose;

an air-filter regulator disposed downstream of the air inlet connection aperture for regulating pressure of an air control signal within a branch pneumatic control circuit;

a first pneumatic control line port disposed to route action of a rinse signal;

a second pneumatic control line port disposed to route action of supply air to a manual control disposed remotely from the panel;

a third pneumatic control line port disposed to route action of return air from the manual control disposed remotely from the panel;

a main blast air inlet valve disposed downstream of the air inlet connection aperture, said main blast air inlet valve branched from the air-filter regulator and the air control signal;

a main air check valve disposed downstream of the main blast air inlet valve;

a blast pressure throttling valve disposed downstream of the main blast air inlet valve; and a blast hose attachment aperture disposed for interconnection with a blast hose.

10. The wet abrasive blast machine conversion kit of claim 8 wherein means for routing fluid through the first hydraulic circuit comprises:

a fill pump connectable to a water source, said fill pump including a fill pump shut off valve and a fill pump check valve;

a blast pump connectable to the water source, said blast pump including a blast pump shut off valve and a blast pump check valve;

a grit metering valve; and a slurry hose pinch valve having an actuator disposed in operational communication with the air control signal;

wherein the air control signal is divertible by a user to selectively engage and alternatively release the slurry hose pinch valve.

11. The wet abrasive blast machine conversion kit of claim 10 wherein means for routing fluid through the second hydraulic circuit comprises:

the blast pump of claim 8;

a rinse shut off valve; and a rinse water solenoid valve having an actuator disposed in operational communication with the air control signal;

wherein the air control signal is controllable by the user to selectively engage and alternatively release the rinse water solenoid valve.

12. The wet abrasive blast machine conversion kit of claim 6 further comprising a pop-up gasket installable in an uppermost aperture disposed within the existing blast pot.

13. The wet abrasive blast machine conversion kit of claim 12 further comprising at least one arcuate member disposed in open communication with a vent stack, said vent stack operationally coupled with the pop-up gasket and a block valve, said at least one arcuate member having a distal end disposed proximal and uppermost point interior to the blast pot wherein air interior to the blast pot may be purged through the vent stack until the block valve closes.

14. A dry to wet abrasive blast machine conversion kit for converting an existing dry blast pot to wet abrasive blasting operations, said conversion kit comprising:

a multi-function fluid manifold attachable at a pressure release aperture disposed upon the existing blast pot, said multi-function fluid manifold comprising:

a fluid inlet valve to control introduction of a non-compressible fluid into the blast pot;

a pressure release valve;

a slurry outlet elbow installable to a lowermost opening of the existing blast pot;

a slurry hose connectable to the slurry outlet elbow;

a control panel attachable to the blast pot and connectable to the slurry hose, said control panel comprising:

a pneumatic circuit comprising:

an air inlet connection aperture;

an air-filter regulator disposed downstream of the air inlet connection aperture;

a main blast air inlet valve disposed downstream of the air inlet connection aperture and branched from the air-filter regulator;

a main air check valve disposed downstream of the main blast air inlet valve;

a blast pressure throttling valve disposed downstream of the main blast air inlet valve;

a blast hose attachment aperture disposed for interconnection with a blast hose;

a first hydraulic circuit comprising:

a fill pump;

a fill pump shut off valve disposed in operational communication with the fill pump;

a fill pump check valve disposed downstream of the fill pump shut-off valve;

a blast pump;

a blast pump shut-off valve disposed in operational communication with the blast pump;

a grit metering valve disposed downstream of the blast pump shut off valve;

a blast pump check valve disposed downstream of the grit metering valve;

a second hydraulic circuit comprising:

the blast pump;

a main control valve-relay;

a rinse control valve-relay;

a remote rinse control valve;

a slurry hose connection port;

a pop-up gasket comprising:

a plunger portion configured to seat into an existing uppermost aperture disposed in the blast pot when said blast pot is pressurized;

a stopper disposed to prevent the pop-up gasket from falling into the blast pot; and a shaft member vertically connecting the plunger portion and the stopper.

15. The conversion kit of claim 14 wherein the multi-function fluid manifold further comprises:

an air purge riser; and an air purge valve disposed in operational communication with the air purge riser;

wherein a high point bleed is operable interior to the blast pot to evacuate air during pressurization and fill of the said pot.

16. The conversion kit of claim 14 wherein the pop-up gasket further comprises:

an air purge riser operatively coupled with the pop-up gasket, said air purge riser having:

at least one arcuate member having a distal end disposed in open communication with an air vent stack operatively coupled with the shaft of the pop-up gasket; and a block valve disposed in operational communication with the air vent stack, said block valve closeable to prevent passage of air through the block valve when a threshold pressure is attained.

* * * * *